US007179358B2

(12) United States Patent
Tominaga et al.

(10) Patent No.: US 7,179,358 B2
(45) Date of Patent: Feb. 20, 2007

(54) METHOD FOR FORMING ELECTRODEPOSITION COATING FILM

(75) Inventors: Akira Tominaga, Kanagawa (JP); Naozumi Iwasawa, Kanagawa (JP); Koji Kamikado, Kanagawa (JP); Yasuyuki Hirata, Kanagawa (JP); Susumu Midogochi, Kanagawa (JP)

(73) Assignee: Kansai Paint Co., Ltd., Kanagawa (JP)

( * ) Notice: Subject to any disclaimer, the term of this patent is extended or adjusted under 35 U.S.C. 154(b) by 621 days.

(21) Appl. No.: 10/417,184

(22) Filed: Apr. 17, 2003

(65) Prior Publication Data

US 2003/0196898 A1 Oct. 23, 2003

(30) Foreign Application Priority Data

Apr. 17, 2002 (JP) ..... 2002-115389
Jan. 28, 2003 (JP) ..... 2003-018351

(51) Int. Cl.
*C25D 13/12* (2006.01)

(52) U.S. Cl. ..... 204/488; 204/509

(58) Field of Classification Search ..... 204/488, 204/509
See application file for complete search history.

(56) References Cited

U.S. PATENT DOCUMENTS 3,740,859 A * 6/1973 Patton et al. ..... 34/247
4,560,579 A * 12/1985 Siadat et al. ..... 427/516
4,756,975 A * 7/1988 Fujii et al. ..... 428/461
6,375,820 B1 * 4/2002 Tomizaki et al. ..... 204/489
6,582,770 B2 * 6/2003 Rekowski et al. ..... 427/385.5

FOREIGN PATENT DOCUMENTS

JP 2000-239896 A * 9/2000
JP 2001-032016 A * 2/2001

* cited by examiner

*Primary Examiner*—Kishor Mayekar
(74) *Attorney, Agent, or Firm*—Rader, Fishman & Grauer PLLC

(57) ABSTRACT

A method for forming an electrodeposition coating film, comprises a step of subjecting a steric metal article to be coated to electrodeposition coating, and a step of selectively heating/drying the resultant coating film by a plurality of induction heating devices.

10 Claims, 1 Drawing Sheet

METHOD FOR FORMING ELECTRODEPOSITION COATING FILM

TECHNICAL FIELD OF THE INVENTION

The present invention relates to a coating film forming method which is excellent in environmental protection, an energy-saving property, a finishing property and a coating film property and in which an article to be coated is heated/dried by an induction heating system before or after electrodeposition coating of the article to be coated.

DESCRIPTION OF RELATED ART

In Japan or Europe and the United States, a paint or a coating system produced in view of environmental problems has been heretofore described, and a cationic electrodeposition paint not containing a poisonous metal such as a heavy metal has been used as an electrodeposition paint in many cases.

In the coating system, a coating film forming method of omitting a baking step is employed in a production line, and reduction in load on the environment, reduction in energy, economic aspect and performance of the coating system are regarded as important. In dry-hard of the coating film, a hot-air drying furnace by a hot-air heating system is mainly used and a method of simultaneously heating/drying the whole article to be coated is being performed.

However, in a case where the hot-air drying furnace is used for heating/drying the article to be coated having a large heat capacity, a long time is necessary for heating the coating film up to a necessary temperature. In addition, a furnace temperature or a hot-air temperature must be kept to a temperature higher than a baking temperature of the coating film, as a result, a part of the steric article to be coated is excessively heated to cause coating film deterioration, or when the furnace temperature or a hot-air rate is changed in the case of changing a thickness or size (in the case of a mixed line, a type or product class of a vehicle) of a steel plate, much time is necessary because the heat capacity of the furnace is very large.

For example, in order to perform the dry-hard of the article having a large surface area, such as a vehicle body, or a thick part such as a frame, the hot-air temperature must be increased, with a large amount of the hot air, to a temperature higher than the maximum ultimate temperature of the article to be coated, by 20 to 30° C. or more, and the high-temperature exhaust hot-air having a large capacity must be filtered by a filter or the like in order to secure a clean degree within the furnace and take into account the environment, so that maintenance or running costs enormously.

Herein, the metallic article to be coated which is continuously manufactured in the production line, such as the vehicle body or the frame part, is subjected to electrodeposition coating for the purpose of attaining a finishing property or an anti-rust property, thereafter washed with water to remove the extra paint and then heated/dried in an atmosphere of 160 to 220° C. for 10 to 60 minutes in the hot-air drying furnace, thereby obtaining a cured coating film.

Other than these problems such as environmental protection, saving of energy and saving of step, examples of the problems in the electrodeposition coating step include the following:

(a) After forming the electrodeposition coating film, the baking of the electrodeposition coating film is performed at a high temperature and therefore, the electrodeposition coating of integrating a vehicle body as a metal with plastic can not be performed because a plastic part such as a bumper or a doorknob is incorporated, so that the saving of step is disadvantageously accomplished.

(b) With the complication of a vehicle body structure by measures against crash, thermal conduction is insufficient, so that a non-cured part is produced on the complicated structure part and an anti-rust property decreases.

(c) In the hot-air drying furnace, the electrodeposition paint pooled in a clearance part or bag part of the vehicle body having the complicated structure oozes out to generate the so-called "secondary sagging and popping" where a general surface has sagging traces or the general surface having thereon the traces of sagging water is abruptly heated to come into a state of popping.

(d) A degreasing solution or chemical conversion treatment solution used in a pre-step of the electrodeposition coating is taken in an electrodeposition tank in a state of pooling it in the bag part or clearance part of the vehicle body, the frame part or the like, so that impure ions such as an alkali metal ion or a phosphoric ion is pooled in the electrodeposition tank to cause cissing or reduction in the finishing property.

(e) Tar and soot are accumulated within the hot-air drying furnace and adhere to the vehicle body to deteriorate the finishing property. Further, cleaning of the tar and the soot takes much time.

(f) In order to recoat a water-base intermediate coat or a water-base top coat by wet on wet after the electrodeposition coating, preheating must be fully performed to evaporate moisture.

Examples of the commonly known method include a method of applying an induction heating system to the heating/drying of the electrodeposition coating film (see Japanese Unexamined Patent Publication (Kokai) No. 2000-239896), an invention relating to an induction heating device to dry the paint coated on a metal surface by the induction heating (see Japanese Unexamined Patent Publication (Kokai) No. 7-124512), and a method of using the induction heating system for drying the steric article such as the vehicle body (see Japanese Unexamined Patent Publication (Kokai) No. 2001-32016), and an object of any of these inventions is to uniformly heat the article to be coated.

Improvement of the problems as described above has been demanded in view of the environmental concerns, the saving of energy or the saving of step.

SUMMARY OF THE INVENTION

As a result of extensive investigations to meet these requests, the present inventors have found that when there is used an induction heating system in which an induced current is generated on a metallic article to be coated to heat/dry the article by Joule heat, the above-described problems can be solved. In consequence, the present invention has been accomplished based on this finding.

More specifically, the present invention is concerned with the following aspects:

The present invention provides a method for forming an electrodeposition coating film, comprising a step of subjecting a steric metal article to be coated to electrodeposition coating, and a step of selectively heating/drying the resultant coating film by a plurality of induction heating devices.

The present invention also provides a method for forming the electrodeposition coating film, comprising a step of subjecting, to electrodeposition coating, a metal part of a steric article to be coated which is integrally composed of a metal and a plastic, and a step of drying/heating the resultant coating film only on the metal part by an induction heating system.

The coating film obtained by subjecting the steric metal article to be coated to the electrodeposition coating may be heated/dried at a different temperature for each part of the steric metal article to be coated, simultaneously by the plurality of induction heating devices.

DESCRIPTION OF THE DRAWINGS

The present inventions will now be described by way of example with reference to the following FIGURE in which.

DETAILED DESCRIPTION OF THE INVENTION

Figure 1:
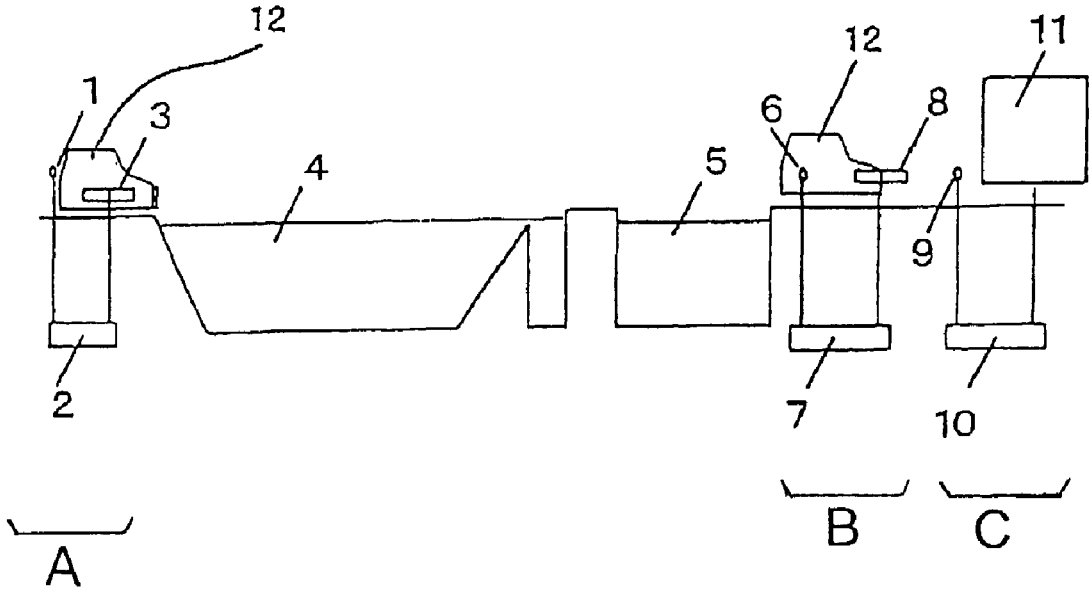
FIG. 1 is a model figure of an electrodeposition facility for a vehicle body.

An electrodeposition coating film forming method of selectively heating/drying an article to be coated by an induction heating system of the present invention is described in detail.

For dry-hard of the electrodeposition coating film, a hot-air heating system is mainly used and has problems as follows: (a) it takes a long time to heat the coating film up to a necessary temperature; (b) since a hot-air temperature must be kept to a temperature higher than a baking temperature of the coating film, a part of the steric article to be coated is excessively heated to reduce a coating film property; (c) it is not easy to change a furnace temperature or a gas volume depending on a thickness or size of a steel plate; (d) it is not easy to intensively heat/dry a specific part only of a vehicle body; (e) it is difficult to heat/dry the vehicle body composed of integrated metal and plastic; and (f) in a wet on wet step of performing electrodeposition coating/preheating/water-base intermediate coating or water-base top coating, facilities cost and maintenance cost for the preheating are heavy.

Consequently, the inventors have found that by using a plurality of induction heating devices, the coating film obtained in the electrodeposition coating can be selectively heated/dried, and therefore, an excellent finishing property or the coating film property can be obtained in addition to the following characteristics: (a) heat is generated on the metallic article to be coated and the heat is not generated on a part other than the metallic article to be coated (e.g., plastic) and therefore, heat efficiency is high, (b) rapid, high-temperature and partially selective heating can be performed; (c) the system is suitable for various heating conditions such as a heating order, a heating temperature or a heating time; (d) the facilities are relatively small; (e) the system is soft for the environment; (f) automation is easily attained. Of course, the coating film can also be simultaneously heat/dried at the different heating temperature every each part of the article to be coated. Alternatively, the coating film can also be simultaneously heat/dried at the same heating temperature while changing the heating time.

The present invention is effective particularly for the vehicle body composed of integrated metal and plastic, where an induction heating device is disposed together with a detector and a controller, and the drying/heating is selectively performed in accordance with a kind or movement of the article to be coated. In the present invention, the order of applying the induction heating to the specific part (e.g., a bag part or a clearance part) of the article to be coated is controlled, and sagging water is evaporated after water washing, or sagging water is sealed within the clearance part by curing the coating film to prevent the secondary sagging and popping. In consequence, the finishing property can be improved, and furthermore, the specific part can be mainly heated to thereby improve the coating film property.

In the case of the article to be coated having the specific part such as the clearance part, a thick part or the bag part, the specific part can be selectively heated/dried by the induction heating system at the beginning and then, the whole article to be coated can be heated/dried by the induction heating system or the hot-air drying system.

Alternatively, such a whole article to be coated may be heated/dried at the beginning by the induction heating system or the hot-air drying system and then, the specific part may be heated/dried by the induction heating system.

As described above, in the case of the article to be coated having the specific part, particularly, having the clearance part or the bag part, the specific part is heated/dried by the induction heating system, whereby sagging water disappears from the clearance part and the secondary sagging or popping can be prevented. In particular, when the clearance part is heated/dried by the induction heating after a pretreatment of the electrodeposition coating, it is preferable because penetration of the electrodeposition paint is accelerated.

By moving one or both of the induction heating device and the article to be coated, the induction heating conditions may be changed and adjusted.

After the electrodeposition coating, the coating film obtained is preliminarily heated/dried by the induction heating system, the water-base intermediate coat and/or the water-base top coat is recoated on the coating film and the coating film formed may be simultaneously heated/dried, whereby the heating/drying step may be shortened.

When an electroconductive pigment or a magnetic pigment is blended with the electrodeposition paint used, the heat efficiency of the induction heating can be improved, and the magnetic pigment, in particular, iron oxide is preferably used in view of the efficiency.

Furthermore, as a result of extensive investigations, the present inventors have found that before the electrodeposition coating, the specific part of the vehicle body is induction-heated and impure ion-containing washing water after chemical conversion treatment is evaporated and thereby, an effect of preventing contamination from being mixed into an electrodeposition tank is obtained and moreover, the method can be applied also to the coating film formation by the wet on wet of recoating the water-base intermediate coat or the water-base top coat on the electrodeposition coating film and therefore, the effect of contributing to environmental protection and energy-saving can be obtained.

FIG. 1 is a model figure of the electrodeposition coating facility. In this example, the electrodeposition coating facility comprises three devices of A, B and C.

The device A has a detector 1, a controller 2 and an induction heating device 3, and performs the electrodeposition coating and heating/drying. In this embodiment, for example, the article 12 is a vehicle body. The device A is provided on the upstream side of an electrodeposition tank 4. After the electrodeposition coating, the vehicle body 12 is taken in the electrodeposition 4 and washed in a water washing zone 5.

The device B comprises a detector 6, a controller 7 and an induction heating device 8. The device B partially heats/dries the article 12 to be coated.

The device C has a detector 9, a controller 10 and an induction heating device 11. The device C heats/dries the whole vehicle body 12.

The device A provided before the vehicle body 12 is taken into the electrodeposition tank 4 may be installed or may not be installed. In the drying process by the induction heating after the electrodeposition coating in the electrodeposition tank 4 and the water washing in the water washing zone 5 are perfomed, whichever the device B for partially heating/drying the vehicle body 12 or the device C for heating/drying the whole vehicle body may come first.

Furthermore, these devices A, B, and C are not necessarily separately arranged (such as on the upstream and downstream sides) on the production facilities, and the device C for heating/drying the whole vehicle body 12 and the device B for partially heating/drying the vehicle body may be disposed at the same place. The heating/drying devices A, B, and C may be movable or can be turned ON/OFF when necessary according to the number of the vehicles produced, a type of the vehicles, or seasons.

FIG. 1 is described in detail. After press molding, the vehicle body 12 is subjected to degreasing or chemical conversion treatment and then taken into the electrodeposition tank 4 and at this time, the water containing impure ions such as an alkali metal ion is brought into the electrodeposition tank 4 in a state where the water is pooled in the clearance part or bag part of the vehicle body 12. As a result, the impure ions are accumulated within the electrodeposition tank 4 to incur reduction in the finishing property in many cases. However, by providing the above-described device A, (a) the type of vehicles 12 is detected by the detector 1, the heating temperature is controlled by the controller 2 and the heating/drying is performed by the induction heating device 3. By virtue of the heating/drying, a smaller amount of the impure ions are taken in and the effect of improving the finishing property can be obtained. In the conventional hot-air drying, the heating/drying device could not be installed because of increase in facilities, space and cost, however, by using the induction heating device 3 or 8, problems were solved.

In the heating/drying of the vehicle body 12 after the electrodeposition coating and the water washing, the above-described device B comprising the detector 6, the controller 7 and the induction heating device 8 is used to partially heat/dry the article 12 to be coated. The vehicle body 12 is washed at several stages by using recycled water, industrial water, purified water and the like, and then heated/dried to cure the coating film. However, with the heating/drying, the paint oozes out and sags from the clearance part of the vehicle body 12, or a sagging part gushes, and as a result, the finishing property of the coating film has been impaired. Therefore, since as a device for selectively heating/drying the article 12 to be coated, the device B comprising the detector 6, the controller 7 and the induction heating device 8 are installed, the effect of improving the secondary sagging and popping properties can be obtained by the effect that the paint in the clearance part is dry-hardened and sealed within the clearance part or moisture is evaporated and volatilized by the heating/drying. By using the plurality of induction heating devices, the partial and selective heating can be performed.

Secondly, as a device for heating/drying the whole vehicle body 12, the above-described device C comprising the detector 9, the controller 10 and the induction heating device 11 is used.

By virtue of this induction heating system, optimization of a dried part or a drying time is attained, and a cleaning frequency of the drying furnace is decreased owing to reduction of tar and soot in the drying furnace, as a result, such a problem that the tar and the soot drop on the vehicle body 12 to impair the finishing property, is reduced.

The above-described induction heating device heats only the metal part and therefore, integration coating can be performed in a state of incorporating plastic parts such as bumpers, doorknobs and mirrors into the vehicle body, and cost cutting such as energy-saving, space-saving and labor-saving can be attained.

Furthermore, when conductive materials are introduced into the plastic parts, also the plastic parts can be electro-painted, and the intermediate coat and the top coat can be integrally coated on the coating film, whereby the same painting color can be obtained on the metal and the plastic.

The electrodeposition coating film is predried by the induction heating system, the water-base intermediate coat or the water-base top coat is recoated on the coating film by the wet on wet and the coating film formed is simultaneously heat-hardened, whereby the environment-friendly coating film comprising a plurality of layers can be obtained.

With respect to the electrodeposition paint, any of a cationic electrodeposition paint and an anionic electrodeposition paint may be used for the electrodeposition coating film heated/dried through the induction heating system, however, for the coating of the vehicle body, the epoxy-urethane-base cationic electrodeposition paint is preferably used in view of anticorrosion property.

In the cationic electrodeposition paint, a base resin used is an amine added epoxy resin and a curing agent used is a block polyisocyanate compound in many cases.

An average molecular weight of the epoxy resin used for the base resin is not particularly different from that of an usual epoxy resin and the average molecular weight is preferably from 1,000 to 10,000, more preferably from 2,000 to 5,000. The amine compound added to the epoxy resin contains a primary amino group, and preferably has an amine number of from 30 to 70 mg KOH/g resin solid content, more preferably from 40 to 60 mg KOH/g resin solid content.

Examples of the polyisocyanate compound as the curing agent include diphenylmethane-2,4# and/or 4,4#-diisocyanate (usually referred to as "MDI"), crude MDI, hydrogenated MDI, adducts of these compounds and polyol, tolylene diisocyanate, adduct of xylylene diisocyanate or phenylene diisocyanate and polyol, adducts of isophorone diisocyanate or bis (isocyanate methyl) cyclohexane and polyol, and isocyanurate compound such as tetramethylene diisocyanate or hexamethylene diisocyanate. Examples of the block agent seed include an oxime compound, alcohols, phenols and caprolactam.

With respect to a blending ratio of the base resin and the block polyisocyanate curing agent in the cationic electrodeposition paint, the base resin can be blended usually in an amount of from 55 to 90% by weight, preferably from 65 to 80% by weight and the block polyisocyanate curing agent can be blended usually in an amount of from 10 to 45% by weight, preferably from 20 to 35% by weight, based on the total solid content weight of both these components.

The cationic electrodeposition paint containing the base resin and the block polyisocyanate curing agent can be prepared by a method where the base resin and the block polyisocyanate curing agent are fully mixed with each other and then, the mixture is neutralized with a water-soluble organic carboxylic acid usually in an aqueous solvent and thereby the epoxy resin is water-solubilized or water-dispersed.

Examples of the pigment used for the cationic electrodeposition paint include a color pigment such as titanium oxide, carbon black and red iron oxide; an extender pigment such as clay, mica, baryta, calcium carbonate and silica; an anti-rust pigment such as aluminum molybdophosphate, aluminum tripolyphosphate, bismuth oxide, bismuth hydroxide, basic bismuth carbonate, bismuth nitrate and bismuth silicate. In the present invention, when a conductive pigment (metal powder) or a magnetic pigment (iron oxide or the like) which can generate heat by the induction heating is incorporated in addition to these pigments, the heating efficiency can be elevated.

The amount of pigments blended is preferably from 1 to 100 parts by weight, more preferably from 10 to 50 parts by weight, per 100 parts by weight of the total solid content of the base resin and the curing agent.

In addition, a curing catalyst, an anti-settling agent or the like can be suitably blended in the cationic electrodeposition paint. Among these, the curing catalyst is effective for accelerating a crosslinking reaction of the base resin and the curing agent, and examples of the curing catalyst include dioctyltin oxide, dibutyltin oxide, tin octoate, dibutyltin dilaurate, dibutyltin dibenzoate, zinc octylate and zinc formate. The amount of the curing catalyst blended is suitably from 0.1 to 10 parts by weight per 100 parts by weight in total of the base resin and the curing agent.

The cationic electrodeposition paint is preferably produced by previously producing the pigment paste and mixing the pigment paste with an emulsion prepared by dispersing the base resin, the curing agent and the like.

The cationic electrodeposition paint is coated under conditions that a tank temperature is from 10 to 35° C., preferably 25 to 32° C., a voltage is from 100 to 400 V, preferably from 150 to 350 V, and a current-passing time is from 10 to 600 seconds, preferably from 120 to 240 seconds, whereby the coating film can be formed.

The water-base intermediate paint: By the induction heating method, the electrodeposition coating film formed as described above is heated/dried to evaporate moisture. Thereafter, on the coating film, the water-base intermediate coat obtained by dispersing in water, using a basic compound, a water-dispersible hydroxyl group-containing resin and the curing agent such as block polyisocyanate or melamine is furthermore recoated by the wet on wet and thereby, the coating film comprising the plurality of layers can be formed. By virtue of this, the effects such as energy-saving, space-saving and environmental protection can be obtained as compared with the preheating by the conventional hot-air drying.

EXAMPLES

Examples and Comparative Examples according to the present invention are described below, however, the present invention is not limited only to these Examples.

Examples and Comparative Examples

Example 1

An electrodeposition tank in a vehicle-coating line was filled with an epoxy-urethane-base cationic electrodeposition paint (a lead-free electrodeposition paint, produced by Kansai Paint Co., Ltd.), and an induction heating device (1) (note 1), an induction heating device (2) (note 2) and an induction heating device (3) (note 3) were installed as a heating/drying facility.

Then, a vehicle body incorporating a fender (polypropylene-made) was subjected to degreasing and chemical conversion treatment, and electropainted so as to have a film thickness of 20 mm. The induction heating device (2) was installed at a position where a bag part was heated/dried, and the bag part was heated/dried so as to keep a temperature at 170° C. for 10 minutes. Furthermore, using the induction heating device (3), the vehicle body was heated/dried so as to keep a surface temperature at 180° C. for 10 minutes. However, thermal conditions express a real temperature-time on the surface of a steric article to be coated.

Examples 2 to 5

Using a vehicle body and a cationic electrodeposition paint similar to Example 1, the vehicle body was coated by drying by induction heating in Table 1.

Comparative Examples 1 to 3

Using a vehicle body and a cationic electrodeposition paint similar to Example 1, the vehicle body was coated by hot-air heating/drying in Table 1. However, heating conditions express a temperature-time in an atmosphere within a drying furnace.

Table 1 shows test contents and results in Examples 1 to 5 and Comparative Examples 1 to 3.

TABLE 1

Table, Heating Drying Conditions and Test Results (Examples)

| | | Drying Furnace | Heating Conditions | Example 1 | Example 2 | Example 3 | Example 4 | Example 5 |
|---|---|---|---|---|---|---|---|---|
| Electrodeposition Heating Drying Conditions | Drying before Electrodeposition | Induction heating (1) (note 1) | 110° C.-5 min | used | — | — | — | — |
| | Partial Heating Drying after Electrodeposition | Induction heating (2) (note 2) | 180° C.-10 min | used | used | used | — | — |
| | Preheating | Induction heating (3) (note 3) | 110° C.-5 min | — | — | — | — | used |
| | | hot air drying | 120° C.-20 min | — | — | — | — | — |
| | Heating Drying after Electrodeposition | Induction heating (3) | 170° C.-10 min | used | used | — | used | — |
| | | hot air drying | 180° C.-40 min | — | — | used | — | — |
| Top Coating Heating/Drying Conditions | | hot air drying | 150° C.-30 min | — | — | — | — | used |
| Test Results | | finishing property on an | | 02 | 023 | 023 | 023 | — |

TABLE 1-continued

| | | | | | | |
|---|---|---|---|---|---|---|
| | | electrodeposition surface (note 4) | | | | |
| | | secondary sagging and popping properties (note 5) | A | A | A | B | — |
| | | integral coating (note 6) | B | B | B | B | — |
| | | anticorrosion property (note 7) | A | A | B | B | — |
| | | top coating property (note 8) | — | — | — | — | B |

| | | | | (Comparative Examples) | | |
|---|---|---|---|---|---|---|
| | | Drying Furnace | Heating Conditions | Comparative Example 1 | Comparative Example 2 | Comparative Example 3 |
| Electrodeposition Heating Drying Conditions | Drying before ElectrodepoSition | Induction heating (1) (note 1) | 110° C.-5 min | — | — | — |
| | partial Heating Drying after ElectrodepoSition | Induction heating (2) (note 2) | 180° C.-10 min | — | — | — |
| | Preheating | Induction heating (3) (note 3) | 110° C.-5 min | — | — | — |
| | | hot air drying | 120° C.-20 min | — | used | used |
| | Heating Drying after Electrodeposition | Induction heating (3) | 170° C.-10 min | — | — | — |
| | | hot air drying | 180° C.-40 min | used | used | — |
| Top Coating Heating/Drying Conditions | | hot air drying | 150° C.-30 min | — | — | used |
| Test Results | | finishing property on an electrodeposition surface (note 4) | | 025 | 026 | — |
| | | secondary sagging and popping properties (note 5) | | C | C | — |
| | | integral coating (note 6) | | C | C | — |
| | | anticorrosion property (note 7) | | B | B | — |
| | | top coating property (note 8) | | — | — | C |

(Note 1) Induction heating (1): Before an electrodeposition coating, an induction heating device was installed so as to heat/dry a bag part of a vehicle body. (Corresponding to 1 to 3 in FIG. 1)

(Note 2) Induction heating (2): After the electrodeposition coating and water washing, the induction heating device was installed so as to heat/dry the bag part of the vehicle body. (Corresponding to 6 to 8 in FIG. 1)

(Note 3) Induction heating (3): After the electrodeposition coating and the water washing, the induction heating device was installed so as to heat/dry the whole vehicle body. (Corresponding to 9 to 11 in FIG. 1)

(Note 4) Finishing property on an electrodeposition surface (Ra value): With respect to surface-roughness on a horizontal surface of an electrodeposition coating film, the Ra value was measured by performing surf test 301 (trade name, simple surface-roughness meter, produced by MITSUTOYO Co., Ltd.).

(Note 5) Secondary sagging and popping properties: The vehicle body after a coating was observed on the secondary sagging and popping state.

A: No problem and good

B: The sagging and popping are slightly observed, however, is a level without a problem.

C: The sagging and popping are present, and is a level where an adjustment such as whet is somewhat required.

D: The sagging and popping are present, and is a level where an appearance is remarkably impaired.

(Note 6) Integral coating: The vehicle body was electropainted in a state of incorporating a plastic part (fender), then heated/dried, and afterward, the state of a doorknob was observed.

B: No problem.

C: Discoloration is observed on the plastic part (fender).

D: Transformation is observed on the plastic part (fender).

(Note 7) Anticorrosion property: A cold-rolled steel plate having a size of 70×150 mm was suspended within a wheel house of the vehicle body and was subjected to from a chemical conversion treatment to an electrodeposition coating to produce an electropainted plate having a film thickness of 20 mm. The electrodeposition coated plate was subjected to a salt spraying test and after the passing of 480 hours, evaluated by performing tape peeling.

A: A tape peeling width is less than 2 mm.

B: A tape peeling width is from 2 to less than 3 mm and in a good range.

C: A tape peeling width is from 3 to less than 4 mm.

D: A tape peeling width is 4 mm or more.

(Note 8) Top coating property: Using the induction heating (2) (Note 2), the electropainted coating film was dried at 110° C. for 5 minutes, or at 120° C. for 20 minutes by hot-air drying.

Thereafter, on the coating film obtained, a water-base top coat (trade name, WBC-710T, produced by Kansai Paint Co., Ltd.) was coated so as to have a film thickness of 15 mm, a clear coat (trade name, MAGICRON TC-71, produced by Kansai Paint Co., Ltd.) was further coated so as to have a film thickness of 40 mm and thereby obtaining the coating film comprising a plurality of layers. The coating film was heated/dried at 150° C. for 30 minutes in a hot-air drying furnace and observed on finishing property.

B: No problem.

C: Gloss or smoothness is deteriorated.

D: Gloss or smoothness is remarkably deteriorated.

When an induction heating system is used for drying a coating film formed, after an electrodeposition coating, on an article to be coated, thermal efficiency is elevated, exhaust air is reduced, environmental concerns, saving of energy and saving of step are attained, a drying furnace length can be greatly shortened and saving of space or saving of labor in maintenance can be attained.

When a bag part or clearance part of a vehicle body or a frame part, where a degreasing solution or chemical conversion treatment solution at a pretreatment of the electrodeposition coating is pooled, is selectively heated/dried by the induction heating system, impure ions such as an alkali metal ion or a phosphoric ion are prevented from being mixed into an electrodeposition tank, and finishing property is improved.

An electrodeposition paint pooled in the clearance part or the bag part of the vehicle body having a complicated structure oozes in the hot-air drying furnace, so that a sagging trace remains on a general surface. In addition, the general surface on which a water trace sags is rapidly heated to have a popping state. Such secondary sagging and popping can be prevented by selectively heating/drying a specific part through the induction heating system to improve the finishing property.

The vehicle body incorporating plastic parts such as bumpers or doorknobs can be electropainted, and the saving of step and the saving of space can be attained. With the complication of a vehicle body structure by measures against crash, a part where thermal conduction is insufficient is mainly and selectively heated/dried by the induction heating system, whereby the anticorrosion property can be improved.

Tar and soot accumulated within the hot-air drying furnace scarcely adhere to the vehicle body to prevent the decrease of the finishing property, and troublesome cleaning of the tar and the soot can be reduced.

When the induction heating system is used for preheating to recoat a water-base intermediate coat or water-base top coat by wet on wet after the electrodeposition coating, saving of energy, saving of space and concern for the environment can be attained.

The disclosure of Japanese Patent Application Nos. 2002-115389 filed on Apr. 17, 2002 and 2003-018351 filed on Jan. 28, 2003 including specification, drawings and claims is incorporated herein by reference in its entirety.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. A method for forming an electrodeposition coating film, comprising steps of:

subjecting a steric metal vehicle body or part to be coated to an electrodeposition coating of lead-free electrodeposition paint, to form a resultant coating film, and selectively heating/drying the resultant coating film by a plurality of induction heating devices;

wherein the steric metal vehicle body or part to be coated has at least one specific part selected from the group consisting of a clearance part, a thick part and a bag part; and wherein the specific part of the steric metal vehicle body or part, which is coated in the resultant coating film, is heated/dried by a first induction heating system; and then the whole of the steric metal vehicle body or part, which is coated in the resultant coating film, is subsequently heated/dried by a second induction heating system or a hot-air heating/drying system.

2. A method for forming an electrodeposition coating film, comprising steps of:

subjecting, to an electrodeposition coating of lead-free electrodeposition paint, a metal part of a steric vehicle body or part to be coated which is integrally composed of a metal and a plastic, to form a resultant coating film, and drying/heating the resultant coating film only on the metal part by an induction heating system;

wherein the steric vehicle body or part to be coated has at least one specific part selected from the group consisting of a clearance part, a thick part and a bag part; and wherein the specific part of the steric vehicle body or part, which is coated in the resultant coating film, is heated/dried by a first induction heating system; and then the whole of the steric vehicle body or part, which is coated in the resultant coating film, is subsequently heated/dried by a second induction heating system or a hot-air heating/drying system.

3. The method for forming the electrodeposition coating film according to claim 1, wherein the resultant coating film is heated/dried at a different temperature and/or for a different time for each part of the steric metal vehicle body or part, which is coated in the resultant coating film, simultaneously by the plurality of induction heating devices.

4. The method for forming the electrodeposition coating film according to any one of claims 1 to 3, wherein the clearance part of the steric vehicle body or part which is coated in the resultant coating film is heated/dried by the induction heating devices or the induction heating system to thereby prevent secondary sagging and popping due to sagging water from the clearance part.

5. The method for forming the electrodeposition coating film according to any one of claims 1 to 3, wherein the clearance part of the steric vehicle body or part which is coated in the resultant coating film is selectively heated/dried in advance by the induction heating devices or the induction heating system to thereby accelerate the penetration of the electrodeposition paint.

6. The method for forming the electrodeposition coating film according to any one of claims 1 to 3, wherein the induction heating devices or the induction heating systems automatically move in accordance with a kind or movement of the steric vehicle body or part which is coated in the resultant coating film, to selectively heat/dry the specific part of the steric vehicle body or part which is coated in the resultant coating film.

7. The method for forming the electrodeposition coating film according to any one of claims 1 to 3, wherein production facilities of the steric vehicle body or part which is coated in the resultant coating film have a detector, a controller and at least one of the induction heating devices or the induction heating systems to perform the heating/drying while automatically changing induction heating conditions in accordance with the kind or movement of the steric vehicle body or part which is coated in the resultant coating film.

8. The method for forming the electrodeposition coating film according to any one of claims 1 to 3, wherein the resultant coating film obtained by the electrodeposition coating is washed with water, heated/dried by the induction heating system, coated with a water-base intermediate paint or a water-base top paint, and simultaneously heated/dried to form a plurality of coating films.

9. The method for forming the electrodeposition coating film according to any one of claims 1 to 3, wherein the lead-free electrodeposition paint contains a specific pigment made of a magnetic material.

10. The method for forming the electrodeposition coating film according to claim 9, wherein the specific pigment made of the magnetic material is iron oxide.

* * * * *